US005513995A

United States Patent [19]

Kurotori et al.

[11] Patent Number: 5,513,995

[45] Date of Patent: May 7, 1996

[54] ELECTRICAL CONNECTING ARRANGEMENT FOR ESTABLISHMENT OF ELECTRICAL CONNECTIONS OF ELECTRONIC PRINTED CIRCUIT BOARDS DETACHABLY MOUNTED IN CABINET

[75] Inventors: Fumio Kurotori; Norihiro Takahashi; Hideo Miyazawa; Noboru Nakama; Shozo Shimada; Norio Suzuki; Kazuya Oorui, all of Kawasaki, Japan

[73] Assignee: Fujitsu Ltd., Kanagawa, Japan

[21] Appl. No.: 231,185

[22] Filed: Apr. 22, 1994

[30] Foreign Application Priority Data

Aug. 13, 1993 [JP] Japan ..... 5-201618

[51] Int. Cl.[6] ..... H01R 9/09

[52] U.S. Cl. ..... 439/64

[58] Field of Search ..... 439/64, 355, 377, 439/378, 374, 701, 61, 540

[56] References Cited

U.S. PATENT DOCUMENTS

| | | | |
|---|---|---|---|
| 3,753,212 | 8/1973 | Yamada et al. . | |
| 4,343,528 | 8/1982 | Lucius et al. | 439/701 X |
| 4,437,717 | 3/1984 | Korzik et al. . | |
| 4,525,771 | 6/1985 | Hänsler et al. . | |
| 4,717,358 | 1/1988 | Chaundy . | |
| 4,836,789 | 6/1989 | Rudy, Jr. et al. | 439/377.2 X |
| 4,940,417 | 7/1990 | Hyogo et al. . | |
| 4,940,428 | 7/1990 | Heidotting et al. . | |
| 4,963,098 | 10/1990 | Myer et al. | 439/378 |
| 5,041,018 | 8/1991 | Arnett . | |
| 5,125,854 | 6/1992 | Bassler et al. | 439/701 X |
| 5,184,961 | 2/1993 | Ramirez et al. | 439/540 X |
| 5,234,348 | 8/1993 | Konsevich et al. | 439/61 |

FOREIGN PATENT DOCUMENTS

| | | |
|---|---|---|
| 0157513A2 | 10/1985 | European Pat. Off. . |
| 0330231A2 | 8/1989 | European Pat. Off. . |
| 0334972A1 | 10/1989 | European Pat. Off. . |
| 0349134A1 | 1/1990 | European Pat. Off. . |
| 0349125A2 | 1/1990 | European Pat. Off. . |
| 1503277 | 3/1978 | United Kingdom . |
| 1534945 | 12/1978 | United Kingdom . |
| 2027289 | 2/1980 | United Kingdom . |
| 1590478 | 6/1981 | United Kingdom . |
| 2113478 | 8/1983 | United Kingdom . |
| 2133221 | 7/1984 | United Kingdom . |
| 2166301 | 4/1986 | United Kingdom . |
| 2199446 | 7/1988 | United Kingdom . |
| 2224891 | 5/1990 | United Kingdom . |
| 2264816 | 9/1993 | United Kingdom . |

*Primary Examiner*—Neil Abrams
*Assistant Examiner*—Daniel Wittels
*Attorney, Agent, or Firm*—Nikaido Marmelstein Murray & Oram

[57] ABSTRACT

An electrical connecting arrangement is provided for establishing electrical connections of electronic printed-circuit boards detachably mounted in a cabinet of an electronic installation at a front side thereof. For the establishment of electrical connections, at least one connector is used, and a connector support member is attached to a rear side of the cabinet. The connector includes two connector halves to be coupled to each other. One of the connector halves is detachably attached to and supported by the support member, and is joined to an end of an electrical cable. The other connector half is securely attached to and by a rear side of the printed-circuit board. The connector halves are aligned with each other upon mounting the printed-circuit board in the cabinet, to thereby ensure coupling of the connector halves.

16 Claims, 8 Drawing Sheets

S1

ELECTRICAL CONNECTING ARRANGEMENT FOR ESTABLISHMENT OF ELECTRICAL CONNECTIONS OF ELECTRONIC PRINTED CIRCUIT BOARDS DETACHABLY MOUNTED IN CABINET

BACKGROUND OF THE INVENTION

1) Field of the Invention

The present invention relates to an electrical connecting arrangement for establishing electrical connections of electronic printed-circuit boards which are inserted into and taken out of a cabinet, a housing or the like.

2) Description of the Related Art

Electronic printed-circuit boards are often detachably mounted in an electronic installation such as a digital transmission apparatus, a main frame computer or the like. Such an electronic installation comprises a plurality of rack sections, each of which includes a top wall portion, and a bottom wall portion. To detachably mount the printed-circuit board in the rack section, the respective top and bottom wall portions are provided with a plurality of upper guide rails arranged at regular intervals and a plurality of lower guide rails arranged at regular intervals, with the upper and lower guide rails being aligned with each other, respectively, and being oriented in a direction in which the printed-circuit boards are inserted into and taken out of the rack section. In particular, the aligned upper and lower guide rails are arranged and constituted so as to be slidably engaged with respective upper and lower edges of an electronic printed-circuit board, whereby the printed-circuit board can be inserted into and taken out of the rack section along the aligned upper and lower guide rails. Of course, the detachable mount of the printed-circuit board is directed to ease of maintenance of the electronic installation.

Each of the rack sections is provided with a rear wall portion, a so called "backplane", for establishing electrical connections of the printed-circuit boards inserted into the rack section in place. Namely, each of the printed-circuit boards is electrically connected to other printed-circuit boards or an outside electronic installation through the intermediary of the backplane, so that input and/or output signals can be interchanged thereamong. Conventionally, it is necessary to use at least two connectors: an inner connector and outer connector, for one printed-circuit board, for the establishment of the electrical connection thereof. In particular, the inner connector includes two inner connector halves which can be coupled to each other: a first inner connector half is attached to a rear or back side of the printed-circuit board; and the other or second inner connector half is attached to an inner wall surface of the backplane. When the printed-circuit board is inserted in place into the rack section, a complete electrical couple of the inner connector halves is achieved. On the other hand, the outer connector also includes two outer connector halves which can be coupled to each other: a first outer connector half is attached to an outer wall surface of the backplane; and the other or second outer connector half is joined to an end of a cable extended from an outside electronic installation or another electronic printed-circuit board mounted in the electronic installation concerned. The second inner connector half is electrically connected to the first outer connector half through wiring provided in the backplane.

As mentioned above, the conventional arrangement necessarily involves at least two inner and outer connectors for one printed-circuit board for establishing the electrical connection thereof. This means that a large number of connectors is necessary for the establishment of electrical connections of all of the printed-circuit boards mounted in the electronic installation.

SUMMARY OF THE INVENTION

Therefore, an object of the present invention is to provide an electrical connecting arrangement for establishing electrical connections of electronic printed-circuit boards detachably mounted in an electronic installation, which are arranged and constituted such that a number of connectors used for the establishment of the electrical connections of the printed-circuit boards can be considerably reduced.

In accordance with an aspect of the present invention, there is provided an electrical connecting arrangement for establishing electrical connection of an electronic printed-circuit board detachably mounted in a cabinet of an electronic installation at a front side thereof, which arrangement comprises: a support member attached to a rear side of the cabinet; and a connector including a first connector half and a second connector half to be coupled to each other, the first connector half being detachably attached to and supported by the support member, the second connector half being securely attached to and by a rear side of the printed-circuit board, the first and second connector halves being aligned with each other upon mounting of the printed-circuit board in the cabinet, to thereby ensure coupling of the first and second connector halves. The arrangement may comprise adjustment means incorporated in the support member for properly adjusting a position at which the support member is attached to the rear side of the cabinet. The first connector half may be joined to an end of a cable.

In accordance with another aspect of the present invention, there is provided an electrical connecting arrangement for establishing electrical connection of an electronic printed-circuit board detachably mounted in a cabinet of an electronic installation at a front side thereof, which arrangement comprises: a support member attached to a rear side of the cabinet; a connector including a first connector half and a second connector half to be coupled to each other, the first connector half being detachably attached to and supported by the support member, the second connector half being securely attached to and by a rear side of the printed-circuit board; and alignment means for aligning the second connector half with the first connector half upon mounting the printed-circuit board in the cabinet, to thereby ensure coupling of the first and second connector halves. The arrangement may comprise adjustment means incorporated in the support member for properly adjusting a position at which the support member is attached to the rear side of the cabinet. The alignment means may comprise guide means provided between the support member and the rear side of the printed-circuit board. The first connector half may be joined to an end of a cable.

In accordance with yet another aspect of the present invention, there is provided an electrical connecting arrangement for establishing electrical connection of an electronic printed-circuit board detachably mounted in a cabinet of an electronic installation at a front side thereof, which arrangement comprises: a support member attached to a rear side of the cabinet; at least one multi-connector including a first multi-connector half and a second multi-connector half to be coupled to each other, the first multi-connector half being detachably attached to and supported by the support member, the second multi-connector half being securely attached to and by a rear side of the printed-circuit board; at least one coaxial type connector including a first coaxial type connector half and a second coaxial connector half to be coupled to each other, the first coaxial type connector half being detachably attached to and supported by the support member, the second coaxial type connector half being securely attached to and by a rear side of the printed-circuit board; and alignment means for aligning the respective second multi-connector half and second coaxial type connector half with the first multi-connector half and the first coaxial type connector half upon mounting the printed-circuit board in the cabinet, to thereby ensure coupling of the respective connector halves. The arrangement may comprise adjustment means incorporated in the support member for properly adjusting a position at which the support member be attached to the rear side of the cabinet. The alignment means may comprise guide means provided between the support member and the rear side of the printed-circuit board. The first multi-connector half may be joined to an end of a multi-cable, and the first coaxial type connector half may be joined to an end of a coaxial cable.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
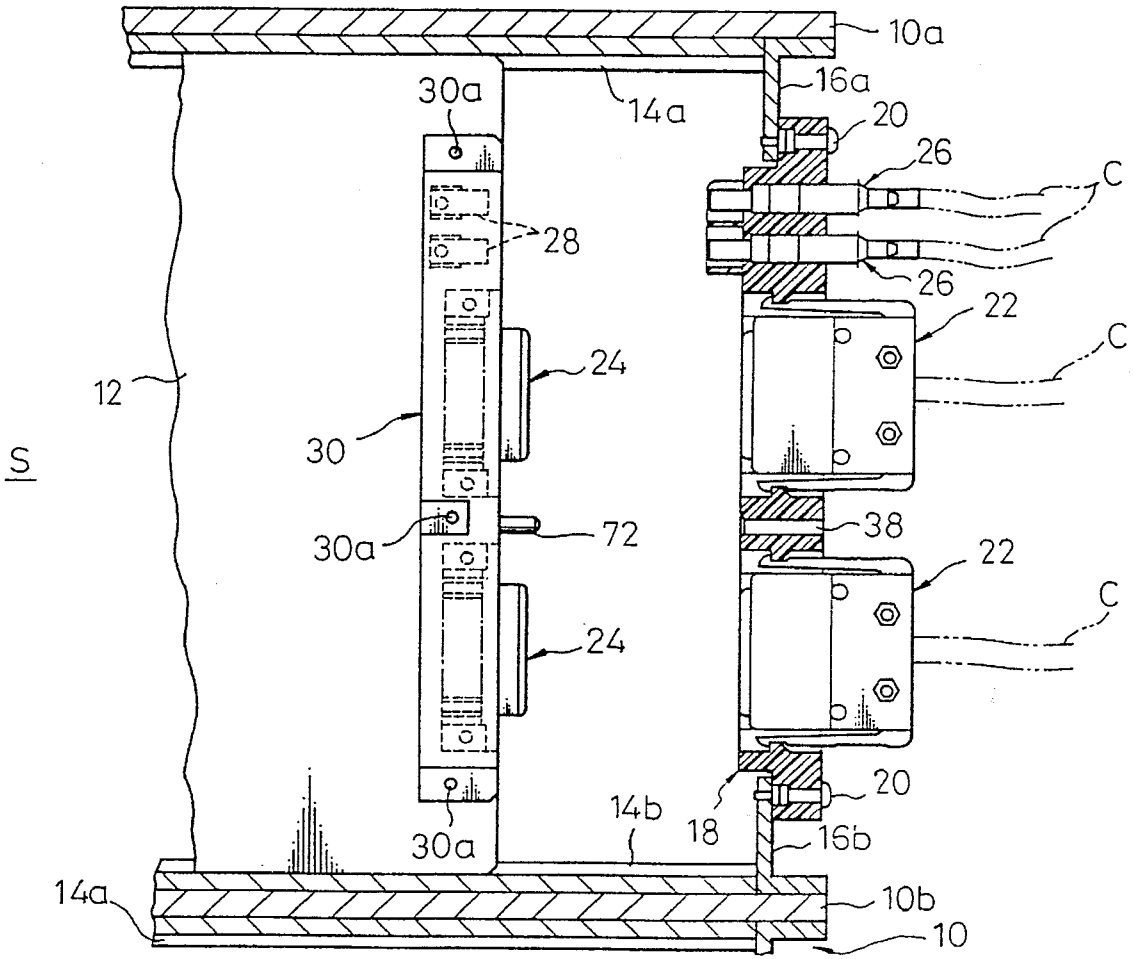
FIG. 1 is a sectional-view partially showing an interior of a rack section of an electronic installation, in which an electrical connecting arrangement according to the present invention is embodied for establishing electrical connections of electronic printed-circuit boards detachably mounted in the electronic installation.

First, reference is made to FIG. 1, there is shown a part of a cabinet for an electronic installation, generally indicated by reference numeral 10: reference **10*a* indicates a top wall of the cabinet 10; and reference 10*b* indicates the uppermost shelf thereof. The top wall 10*a* and the uppermost shelf 10*b* define the uppermost rack section S of the cabinet 10, in which a plurality of electronic printed-circuit boards 12 are arranged side by side at regular intervals. Note, in FIG. 1, only one of the printed-circuit boards 12 is visible. On the top wall 10*a*, a plurality of upper guide rails 14*a* is securely fixed and arranged side by side, and the uppermost shelf 10*b* provides a bottom wall portion of the rack section S, on which a plurality of bottom guide rails 14*b* is securely fixed and arranged side by side. The upper and lower guide rails 14*a* and 14*b* are aligned with each other, respectively, and are oriented in a direction in which the printed-circuit boards 12 are inserted into and taken out of the rack section S. Respective upper and lower edges of an electronic printed-circuit board 12 are slidably received in the aligned upper and lower guide rails 14*a* and 14*b*, as shown in FIG. 1, and thus the printed-circuit board 12** can be inserted into and taken out of the rack section S therealong.

Note, although not illustrated, the cabinet 10 includes further rack sections positioned below the uppermost rack section S. In this case, the uppermost rack **14*b* provides a top wall portion of the next rack section positioned just below the uppermost rack section, on which another plurality of upper rails 14*a* are securely fixed and arranged side by side at regular intervals, as partially shown in FIG. 1**.

The rack section S is provided with a pair of upper and lower frame members **16*a* and 16*b* provided at a rear or back side thereof, and the upper and lower frame members 16*a* and 16*b* are securely attached to and extended along upper and lower sides which partially define a rear opening of the rack section S. A connector support member 18 spans the upper and lower frame members 16*a* and 16*b*, and is detachably attached thereto by a pair of screws 20**.

In the illustrated embodiment, two multi-connectors adapted for low frequency signals and two coaxial connectors are used to establishing electrical connections to the printed-circuit board 12. The multi-connectors may be identical to each other, and also the coaxial connectors may be identical to each other. Each of the multi-connectors includes a female type multi-connector half 22 and a male type multi-connector half 24 which can be coupled to each other, and each of the coaxial connectors includes a male type coaxial connector half 26 and a female type coaxial connector half 28 which can be coupled to each other. The female type multi-connector halves 22 and the male type coaxial connector halves 26 are detachably attached to the connector support member 18, whereas the male type multi-connector halves 24 and the female type coaxial connector halves 28 are fixed to and arranged along a rear side of the printed-circuit board 12. As shown in FIG. 1, the printed-circuit board 12 is preferably provided with a cover member 30 attached to the rear side thereof, for protecting the female type multi-connector halves 24 and the male type coaxial connector halves 28. Each of the female type connector halves 22 is joined to an end of signal cable, and each of the male type coaxial connector halves 26 is joined to an end of a coaxial cable. In FIG. 1, these cables are shown by phantom lines, and are indicated by reference C. By introducing the printed-circuit board 12 from a front opening of the rack section S thereinto along the upper and lower guide rails 14*a* and 14*b*, the male type multi-connector halves 24 and the female type coaxial connector halves 28 are coupled to the female type multi-connector halves 22 and the male type coaxial connector halves 26, respectively. Note, the multi-connectors and the coaxial connectors mentioned above are well known, and are readily available commercially.

Figure 2:
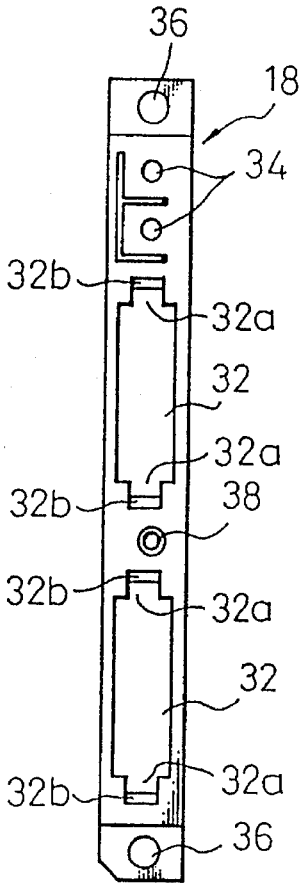
FIG. 2 is a front view of a connector support member forming an element of the electrical connecting arrangement according to the present invention.
Figure 3:
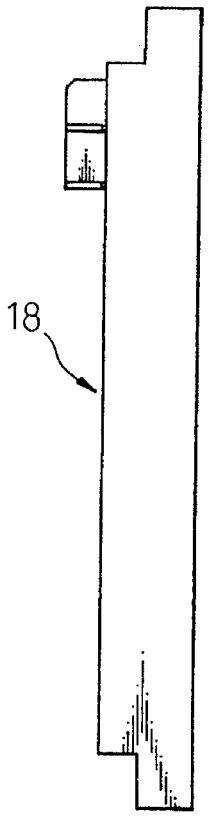
FIG. 3 is a side view of the connector support shown in FIG. 2.
Figure 4:
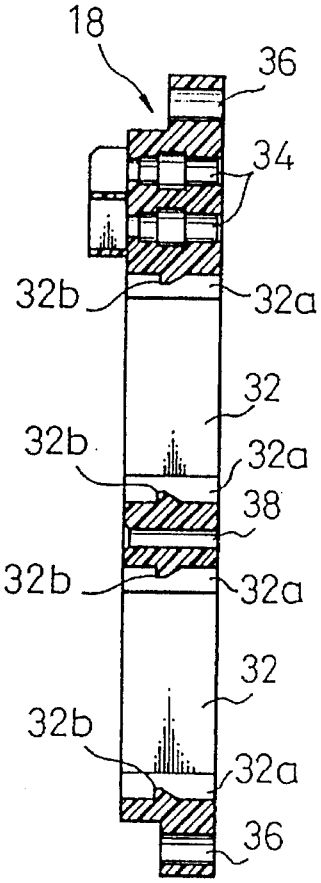
FIG. 4 is a longitudinal cross-sectional view of the connector support member shown in FIG. 2.

FIGS. 2, 3, and 4 show the connector support member 18 in detail, which is preferably constituted as an integrally-formed part, and which may be made of a suitable insulation material such as a synthetic resin material. The support member 18 has an elongated appearance, and is provided with two rectangular openings 32 and two circular openings 34 formed therein and longitudinally aligned with each. Each of the rectangular openings 32 is sized so as to accommodate the corresponding female type multi-connector half 22, and each of the circular openings 34 is sized so as to accommodate the corresponding male type coaxial connector half 26. As is apparent from FIGS. 2 and 4, two grooves 32*a* are formed in the longitudinally opposed side wall portions of each rectangular opening 32, and a projection 32*b* is integrally protruded from a bottom of each groove 32*a*. The support member 18 is also provided with two bores 36 formed at the ends thereof for receiving the screws 20, and a guide pin receiving hole 38 formed therein and disposed at a location between the rectangular openings 32.

Figure 5:
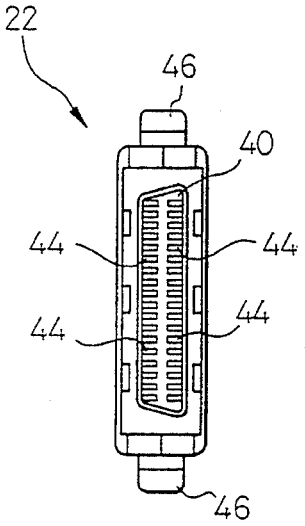
FIG. 5 is a front view of a female type multi-connector half associated with the electrical connecting arrangement according to the present invention.
Figure 6:
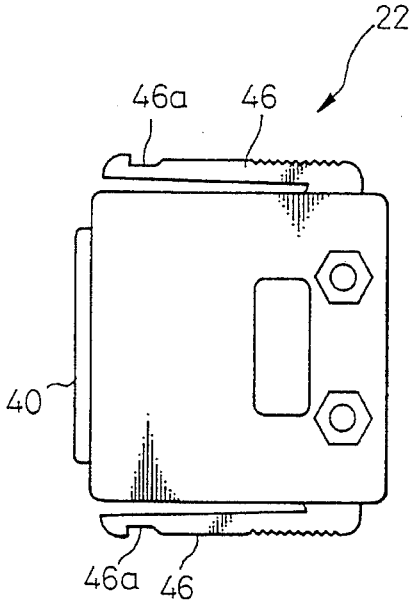
FIG. 6 is a plane view of the female type multi-connector half shown in FIG. 5.
Figure 7:
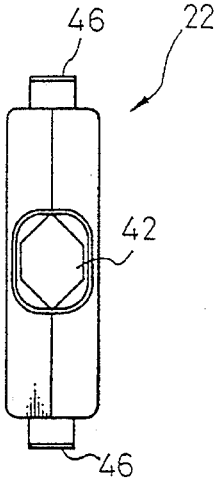
FIG. 7 is a rear view of the female type multi-connector half shown in FIG. 5.

FIGS. 5, 6, and 7 show the female type multi-connector half 22 in detail, which includes two casing halves detachably mated with each other and made of a suitable synthetic resin material. The female type multi-connector half 22 has a connecting mouth 40 provided in a front side thereof, and a hole 42 formed in a rear side thereof for joining the end of the signal cable thereto. As shown in FIG. 5, the female type multi-connector half 22 also has a plurality of female type contacts 44 arranged within the connecting mouth 40, and these contacts 44 are electrically connected to electrical wires included in the signal cable. Further, the female type multi-connector half 22 has two resilient arm elements 46 integrally formed with one of the casing halves thereof, and these arm elements 46 are projected from and extended along the sides of the casing half concerned. As best shown in FIG. 6, each of the resilient arm elements 46 is provided with a notch 46*a* formed therein, and the notch 46is oriented outward and displaced in the vicinity of the free end of the arm element 46. When the female type multi-connector half 22 is inserted into the corresponding rectangular opening 32 of the support member 18 such that the respective arm elements 46 are received in the grooves 32*a*, the respective notches 46*a* of the arm elements 46 are snugly engaged with the projections 32*a*, as shown in FIG. 1, whereby the female type multi-connector half 22 can be positioned and locked in place within the corresponding rectangular opening 32. On the other hand, when the arm elements 46 are pinched and pressed in by a person's fingers such that the respective notches 46*a* thereof are disengaged from the projections 32*a*, the female type multi-connector half 22 can be easily removed out of the rectangular opening 32.

Figure 8:
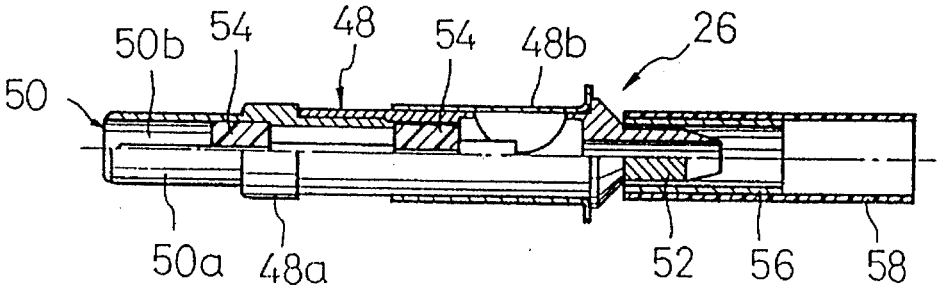
FIG. 8 is a partially-sectional view of a male type coaxial connector half associated with the electrical connecting arrangement according to the present invention.
Figure 9:
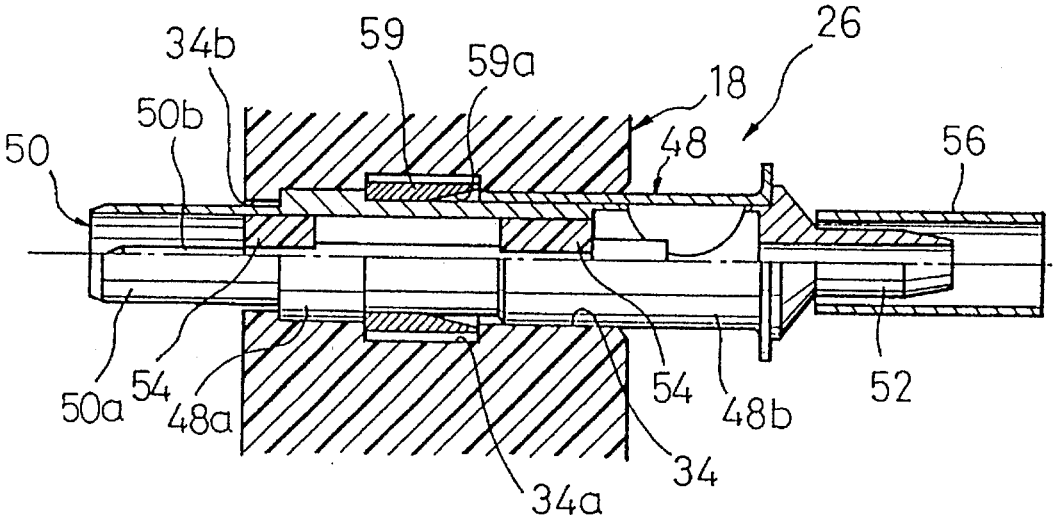
FIG. 9 is a partially-sectional view similar to FIG. 8, but showing the male type coaxial connector half attached to the connector support member.

FIGS. 8 and 9 show the male type coaxial connector half 26 in detail, which comprises a cylindrical body 48 made of a suitable metal material. The cylindrical body 48 has an enlarged head 48*a* integrally formed at a front end thereof, and is provided with a sleeve element 48*b* slidably mounted thereon. A diameter of the enlarged head 48*a* is somewhat larger than that of the cylindrical body 48 per se, and is substantially equal to that of the sleeve element 48*b*. The male type coaxial connector half 26 has a connecting portion 50 provided at a front end thereof, and a terminal 52 formed as the rear end of the cylindrical body 48 for joining the end of the coaxial cable thereto. The connecting portion 50 includes a sleeve-like contact 50*a* integrally extended from the enlarged head 48*a* of the cylindrical body 48, and a male type needle-like contact 50*b* concentrically disposed in the cylindrical body 48. The needle-like contact 50*b* is securely supported by plug elements 54 securely provided within the cylindrical body 48 and made of an insulation material such as a suitable synthetic resin material. As is apparent from FIGS. 8 and 9, a front end portion of the needle-like contact 50*b* is protruded out of the enlarged head 48*a*, and is thus surrounded by the sleeve-like contact 50*a*. The terminal 52 of the male type coaxial connector 26 is formed as the rear end of the cylindrical body 48, and is joined to the end of the coaxial cable, in a well-known manner, by using a sleeve-like metal fitting 56 and a heat-shrinkable tubing 58.

As shown in FIG. 9, the circular openings 34 for accommodating the male type coaxial connector half 26 generally has an inner diameter substantially equal to that of the enlarged head 48*a* of the cylindrical sleeve 48, but it includes an enlarged bore section 34*a* formed in a middle thereof, and a reduced bore section 34*b* disposed at a front end zone thereof. A distance between a front edge of the enlarged bore section 34*a* and a rear edge of the reduced bore section is substantially equal to an axial length of the enlarged head 48*a*. A split collar-like spring element 59 is disposed in the enlarged bore section 34*a*, and has an inner diameter substantially equal to the outer diameter of the cylindrical body 48. As is apparent from FIG. 9, the split collar-like spring element 59 has an inner conical surface 59*a* formed at a rear end thereof, and the inner conical surface 59*a* is spread toward the rear end edge of the spring element 59. With this arrangement, when the male type coaxial connector half 26 is inserted into the corresponding circular opening 34 of the support member 18 the split collar-like spring element 59 is expanded by thrusting the enlarged head 48*a* of the cylindrical body 48 against the conical surface 59*a* of the spring element 59. Then, when the enlarged head 48*a* of the cylindrical body 48 clears the split collar-like spring element 59, the male type coaxial connector half 26 is locked in place within the circular opening 34, as shown in FIG. 9. On the other hand, when the sleeve element 48*b* slidably mounted on the cylindrical body 48 is thrust against the conical surface 59*a* of the spring element 59, and when a front end edge of the sleeve element 48*b* is abutted against the rear edge of the enlarged head 48*a*, the male type coaxial connector half 26 can be easily removed out of the circular opening 32.

Figure 10:
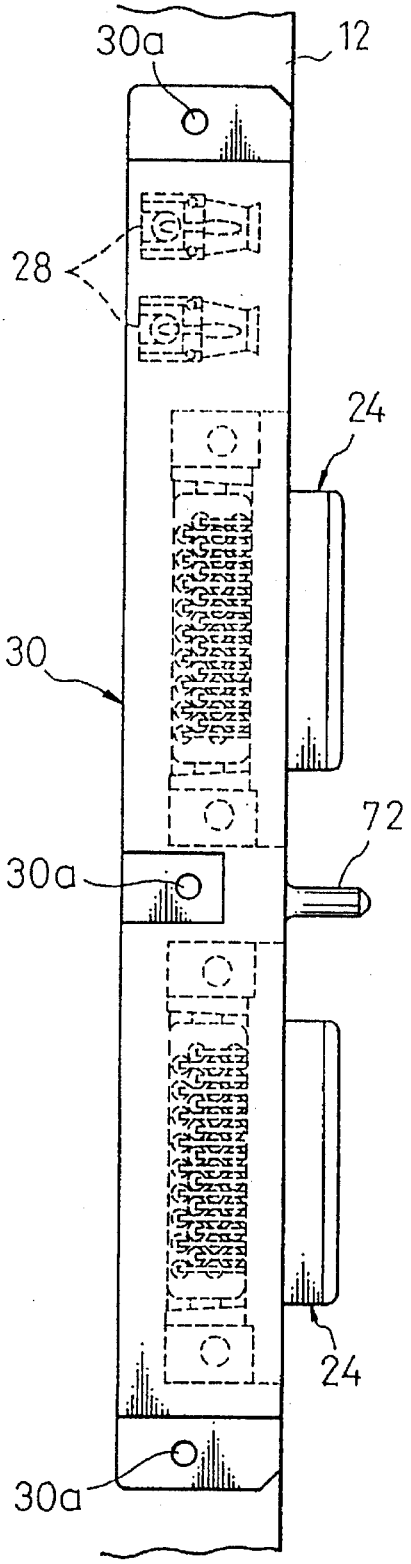
FIG. 10 is an enlarged side view showing a part of a rear side of the printed-circuit board.
Figure 11:
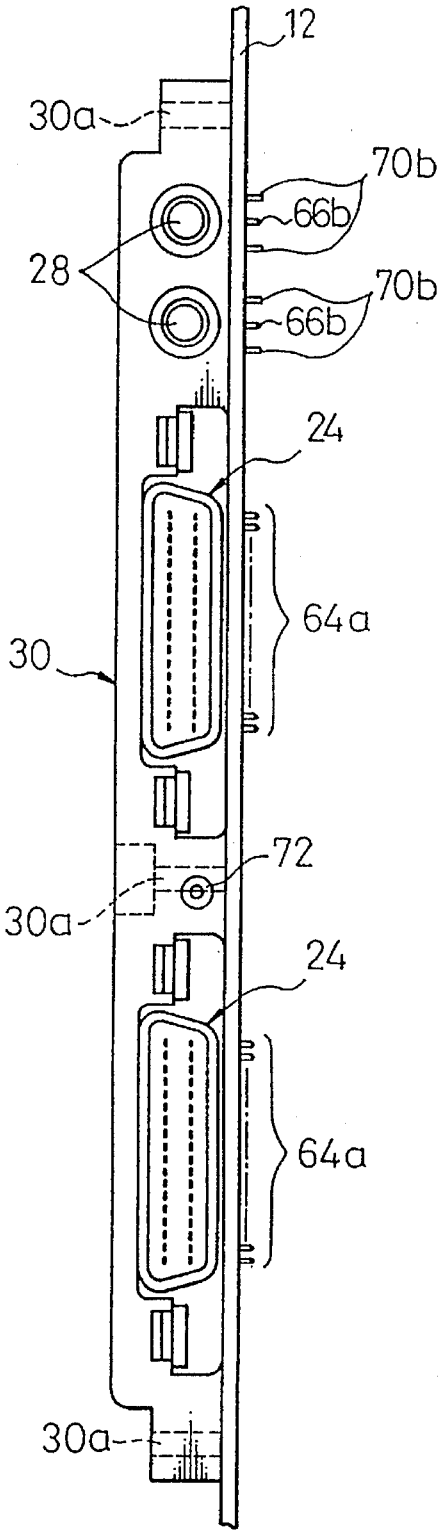
FIG. 11 is a rear side view of the part shown in FIG. 10.
Figure 12:
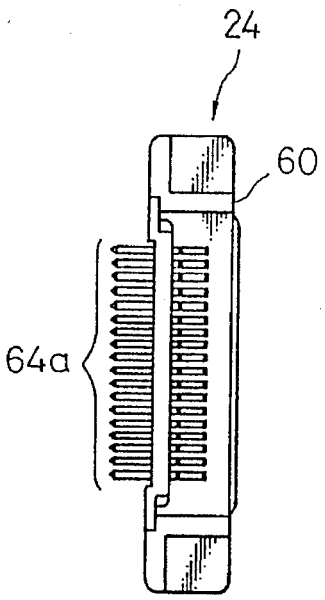
FIG. 12 is a rear view of a male type multi-connector half to be coupled to the female type multi-connector half shown in FIGS. 5 to 7.
Figure 13:
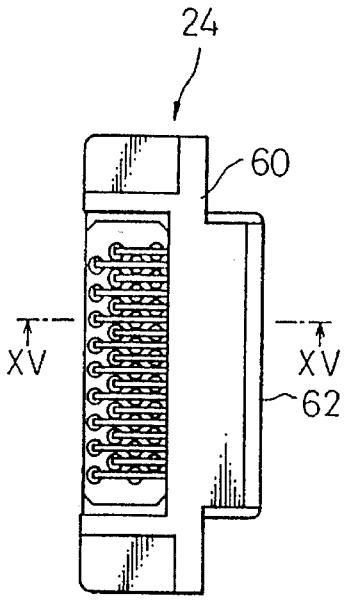
FIG. 13 is a plane view of the male type multi-connector half shown in FIG. 12.
Figure 14:
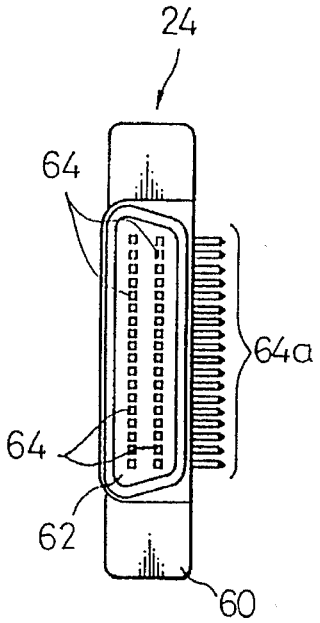
FIG. 14 is a front view of the male type multi-connector half shown in FIG. 12.

FIGS. 10 and 11 enlargedly show a part of the rear side of the printed circuit board 12, to which the male type multi-connector halves 24 and the female type coaxial connector halves 28 are attached. FIGS. 12 to 15 show the details of the male type multi-connector half 24, and FIGS. 16 to 20 show the details of the female type multi-connector half 28.

Figure 15:
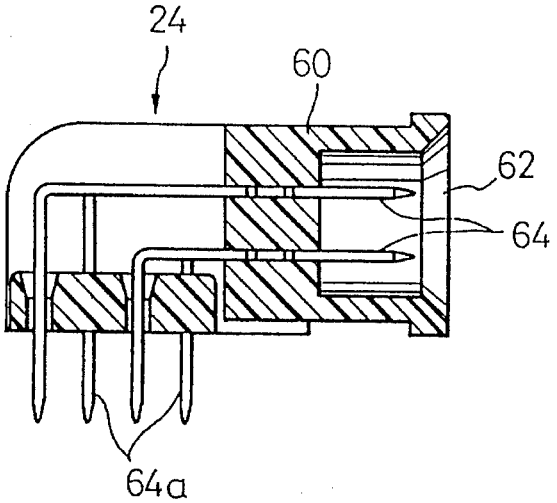
FIG. 15 is a cross-sectional view taken along the line XV—XV of FIG. 13.
Figure 16:
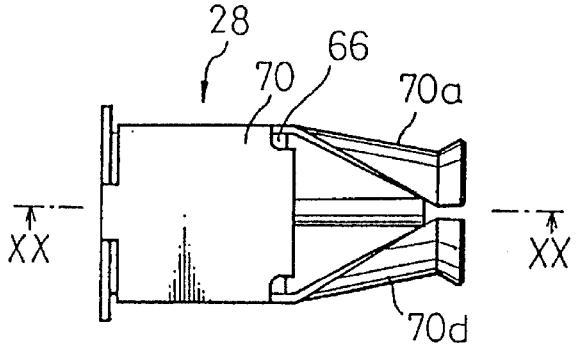
FIG. 16 is a plane view of a female type coaxial connector half to be coupled to the male type coaxial connector half shown in FIGS. 8 and 9.
Figure 17:
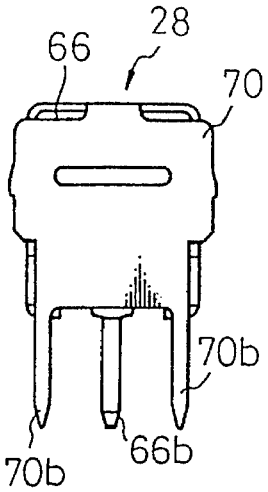
FIG. 17 is a rear view of the female type coaxial connector half shown in FIG. 16.
Figure 18:
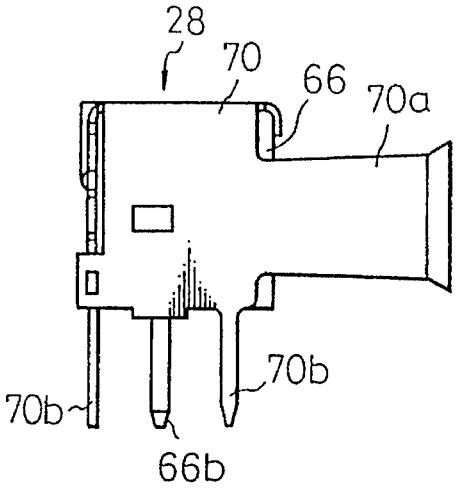
FIG. 18 is a side view of the female type coaxial connector half shown in FIG. 16.

As shown in FIGS. 12 to 15, the male type multi-connector half 24 includes a connector body 60 which is preferably constituted as an integrally-formed part, and which is made of a suitable synthetic resin material. The connector body 60 has a connecting socket 62 formed therein, and a plurality of male type needle-like contacts 63 is arranged within the connecting socket 62. As best shown in FIG. 15, the male type needle-like contacts 63 are embedded in the material of the connecting body 60 which forms a bottom of the connecting socket 62, and are extended out of the bottom of the connection socket 62. The extension of each needle-like contacts 63 is bent at a right angle to pass through a hole formed in a portion of the connecting body 60, and terminates at a lead pin 64*a*. When the male type multi-connector half 24 is attached to the printed-circuit board 12, the lead pins 64*a* are inserted through and soldered in holes formed in the printed-circuit board 12, as is apparent from FIG. 11. The connecting socket 62 of the male type multi-connector half 24 is sized so as to receive the connecting mouth 40 of the female type multi-connector half 22 (FIGS. 5 to 7). Accordingly, when the male type multi-connector half 24 is coupled to the female type multi-connector half 22 (FIGS. 5 to 7), the connecting socket 62 slidably receives the connecting mouth 40, and thus the respective male type needle-like contacts 63 are inserted into the female type contacts 44.

Figure 19:
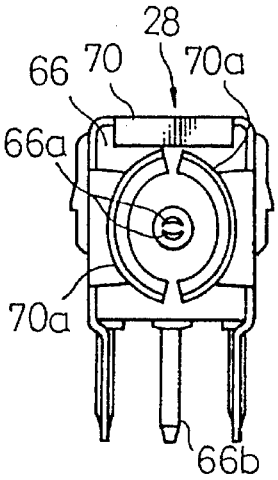
FIG. 19 is a front view of the female type coaxial connector half shown in FIG. 16.
Figure 20:
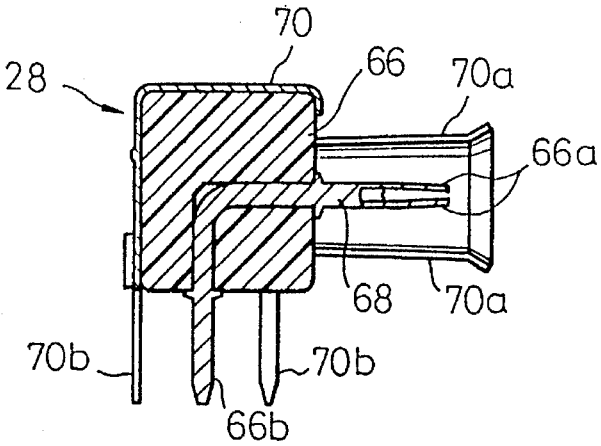
FIG. 20 is a cross-sectional view taken along the line XX—XX of FIG. 16.

As shown in FIGS. 6 to 20, the female type coaxial connector half 28 includes a connector body 66 which is preferably constituted as an integrally-formed part, and which is made of a suitable synthetic resin material. The female type axial connector half 28 also includes a female type contact 68 partially embedded in the connector body 66, and a portion of the female type contact 68 is protruded from the connector body 66, and terminates at a pair of leaf spring elements 66*a* which is arranged to define an elongated narrow passage for resiliently receiving the male type needle-like contact 50*b* of the male type coaxial connector half 26 (FIGS. 8 and 9). The female type contact 68 has an extension bent therefrom at a right angle, and the extension is protruded from the connector body 66, and terminates at a lead pin 66*b*. The female type coaxial connector half 28 further includes a shaped shield member 70 made of a suitable metal sheet material, and the connector body 66 is covered with the shaped shield member 70, as shown in FIG. 16 to 20. The shield element 70 has a pair of tongue elements 70*a* integrally protruded therefrom, and the tongue elements 70*a* concentrically surround the female type contact 68, and therefore the pair of leaf spring elements 66*a*. The tongue elements 70*a* are arranged and shaped so as to define a circular mouth for receiving the sleeve-like contact 50*a* of the male type coaxial connector half 26, as best shown in FIG. 19. Also, the shield element 70 has four lead pins 70*b* protruded therefrom and arranged in parallel with the lead pin 66*b*. When the female type coaxial connector half 28 is attached to the printed-circuit board 12, the lead pin 66*b* and the lead pins 70*b* are inserted through and soldered in holes formed in the printed-circuit board 12, as is apparent from FIG. 11. When the male type coaxial connector half 26 is coupled to the female type coaxial connector half 28, the respective sleeve-like contact 50*a* and male type needle-like contact 50*b* are resiliently received by the pair of leaf spring elements 66*a* and the pair of tongue elements 70*a*.

As mentioned above, the female type multi-connector halves 24 and the male type coaxial connector halves 28 attached to the printed-circuit board 12 are covered by the cover member 30 for protection thereof. The cover member 30 may be securely attached to the printed-circuit board 12 by screws. Note, although these screws are not illustrated, three screw holes formed in the printed-circuit board 12 to receive the screws are indicated by reference 30*a* in FIGS. 1, 10, and 11. The cover member 30 has a guide pin 72 protruded therefrom, and the guide pin 72 is arranged to be inserted into the guide pin receiving hole 38 formed in the connector support member 38, under the conditions that the support member 38 is properly positioned in place, and that the printed-circuit board 12 is properly guided by the aligned guide rails 14*a* and 14*b*. The insertion of the guide pin 72 into the hole 38 ensures that the respective female type multi-connector half 22 and male type coaxial connector half 26 can be properly coupled to the male type multi-connector half 24 and the female type coaxial connector half 28. Of course, more than one set of guide pin 72 and hole 30 may be provided between the printed-circuit board 12 and the support member 18.

Figure 21:
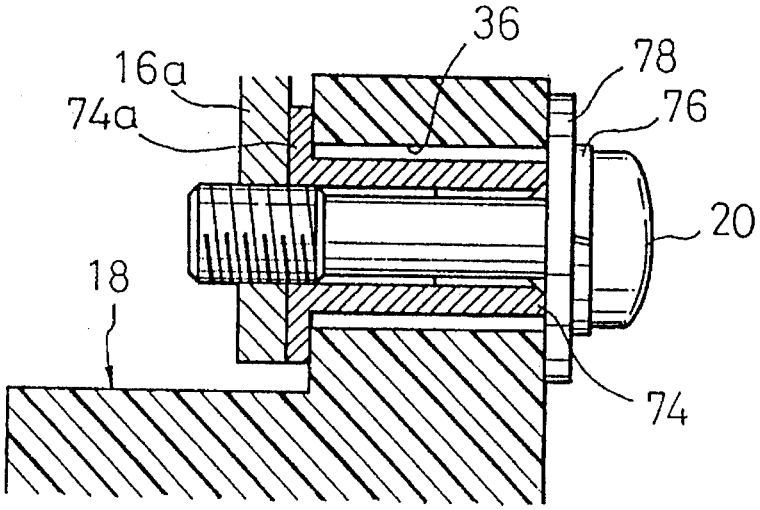
FIG. 21 is a sectional view showing a upper end portion of the connector support member attached to a frame member in a preferable manner.
Figure 22:
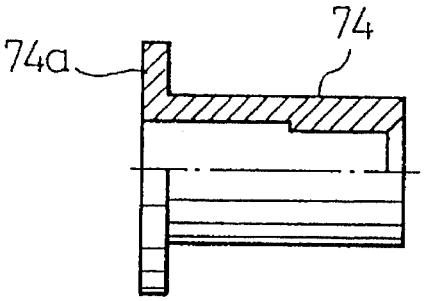
FIG. 22 is a partially-sectional view showing a sleeve member used in the attachment manner shown in FIG. 22.
Figure 23:
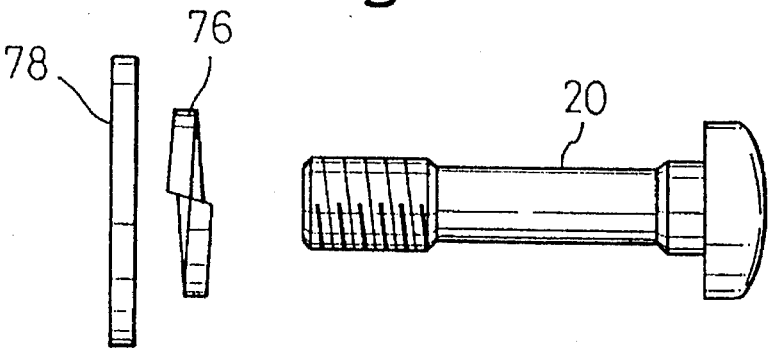
FIG. 23 is a side view showing a screw, used in the attachment manner shown in FIG. 22, together with a spring washer and a washer to be equipped therewith.

FIG. 21 shows a preferable manner in which the connector support member 18 is attached to the frame members 16*a* and 16*b* by the screws 20. Note, although FIG. 21 illustrates only how the upper end of the support member 18 is attached to the frame member 16*a*, the same is true for an attachment of the lower end thereof to the frame member 16*b*. The attachment manner involves a sleeve member 74 as shown in FIG. 22, and the sleeve member 74 has a flange 74*a* integrally formed at one end thereof. The sleeve element 74 is movably received in the hole 36 formed in the upper end of the support member 18, and is disposed such that the flange 74*a* thereof is pinched between the frame member 16*a* and the support member 18. Namely, an inner diameter of the hole 36 is sufficiently larger than an outer diameter of the sleeve element 74 so that the sleeve member 74 is movable to a given extent. After the sleeve member 74 is received in the hole 36, the screw 20 is inserted into the sleeve element 74, but the screw 20 is previously equipped with a spring washer 76 and a washer 78, as shown in FIG. 23. Then, the screw 20 is screwed into a threaded hole formed in the frame member 16*a*, but it is not completely tightened in the threaded hole. Namely, the screw 20 is provisionally tightened in the threaded hole such that the support member 18 can be adjustably moved to be properly positioned. After the proper positioning of the support member 18 is carried out, the screw 20 is completely tightened in the threaded hole. This is very significant because the threaded hole can be formed without the need for close tolerances.

As is apparent from the foregoing, with the electrical connecting arrangement according to the present invention, a connector half is provided on a printed-circuit board can be directly coupled to the opposing connector half joined to a calbe, to establish the electrical connection thereof. Accordingly, it is possible to considerably reduce the number of connectors used for the establishment of the electrical connections of all of the printed-circuit boards mounted in the cabinet.

Finally, it will be understood by those skilled in the art that the foregoing description is of a preferred embodiment of the disclosed electrical connecting arrangement, and that various changes and modifications may be made to the present invention without departing from the spirit and scope thereof.

We claim:

1. An electric connecting arrangement for establishing electrical connection of an electronic printed-circuit board detachably mounted in a cabinet of an electronic installation at a front side thereof which arrangement comprises:

a connector support member wherein said support member has a sleeve hole with an internal diameter;

a sleeve member that comprises a sleeve portion and a flange portion, wherein an outside diameter of said sleeve portion is less than said internal diameter of said sleeve hole and an external diameter of said flange portion is greater that said internal diameter of said sleeve hole, wherein said sleeve member attaches said support member to the cabinet; and at least one connector including a first connector half and a second connector half to be coupled to each other, said first connector half being detachably attached to and supported by said connector support member, said second connector half being securely attached to and by a rear side of the printed-circuit board, said first and second connector halves being aligned with each other upon mounting the printed-circuit board in the cabinet, to thereby ensure coupling of said first and second connector halves.

2. An electrical connecting arrangement as set forth in claim 1, wherein said first connector half is joined to an end of a cable.

3. An electrical connecting arrangement as claimed in claim 1 that further comprising:

alignment means for aligning said second connector half with said first connector half upon mounting the printed-circuit board in the cabinet, to thereby ensure coupling of said first and second connector halves.

4. An electrical connecting arrangement as set forth in claim 3, wherein said means comprises guide means provided between said support member and the rear side of the printed-circuit board.

5. An electrical connecting arrangement as set forth in claim 3, wherein said first connector half is joined to an end of a cable.

6. An electrical connecting arrangement as claimed in claim 1, further comprising:

at least one multi-connector including a first multi-connector half and a second multi-connector half to be coupled to each other, said first multi-connector half being detachably attached to and supported by said support member, said second multi-connector half being securely attached to and by a rear side of the printed-circuit board;

at least one coaxial type connector including a first coaxial type connector half and a second coaxial connector half to be coupled to each other, said first coaxial type connector half being detachably attached to and supported by said support member, said second coaxial type connector half being securely attached to and by a rear side of the printed-circuit board; and alignment means for aligning said respective second multi-connector half and second coaxial type connector half with said first multi-connector half and said first coaxial type connector half upon mounting the printed-circuit board in the cabinet, to thereby ensure coupling of said respective connector halves.

7. An electrical connecting arrangement as set forth in claim 6, wherein said means comprises guide means provided between said support member and the rear side of the printed-circuit board.

8. An electrical connecting arrangement as set forth in claim 6, wherein said first multi-connector half is joined to an end of a multi-cable, and said first coaxial type connector half is joined to an end of a coaxial cable.

9. A connector supporting device for detachably holding a first connector half adapted to be coupled to a second connector half, which device comprises:

a connector support member wherein said support member has a sleeve hole with an internal diameter;

a sleeve member that comprises a sleeve portion and a flange portion, wherein an outside diameter of said sleeve portion is less than said internal diameter of said sleeve hole and an external diameter of said flange portion is greater that said internal diameter of said sleeve hole, wherein said sleeve member attaches said support member to the cabinet;

wherein said connector support member having an opening formed therein for accommodating said first connector half; and a detachable engagement means provided in the opening of said connector support member so as to be engaged with said first connector half upon inserting said first connector half in the opening of said connector support member, whereby said second connector half can be coupled to the first connector half held by said connector support member.

10. A connector supporting device as set forth in claim 9, wherein the respective first and second connector halves comprise a female type multi-connector half and a male type multi-connector half.

11. A connector supporting device as set forth in claim 10, wherein said female type multi-connector half has two resilient arm elements projected from and extended along opposed sides thereof, and said detachable engagement means comprises two projections provided in the opening of said connector support member, the resilient arm elements of said female type multi-connector half being snugly engaged with said projections, and being disengaged from said projections by pressing in said resilient arm elements.

12. A connector supporting device as set forth in claim 9, wherein the respective first and second connector halves comprise a male type coaxial connector half and a female type coaxial connector half.

13. A connector supporting device as set forth in claim 10, wherein and said male type coaxial connector half has an enlarged head formed thereon and is provided with a sleeve element slidably mounted thereon and having the same diameter as that of said enlarged head, and said detachable engagement means comprises a split collar-like spring element disposed in the opening of said connector support member, the male type coaxial connector half being engaged with said split collar-like spring element by making said enlarged head to clear said split collar-like spring element, and being disengaged from said split collar-like spring element by inserting said sleeve element therein.

14. A connector supporting device as claimed in claim 9 further comprising:

a female type multi-connector half adapted to be accommodated in an opening formed in a support structure, comprising two resilient arm elements projected from and extended along opposed sides thereof, the respective resilient arm elements being snugly and detachably engaged with tow projections provided in the opening of said support structure.

15. A connector supporting device as claimed in claim 9 further comprising:

a male type coaxial connector half adapted to be accommodated in an opening formed in a support structure, comprising an enlarged head formed thereon, and a sleeve element slidable mounted thereon and having the same diameter as that of said enlarged head, said enlarged head being engaged with a split collar-like spring element disposed in the opening of said support structure, by making said enlarged head to clear said split collar-like spring element, and being disengaged from said split collar-like spring element by inserting said sleeve element therein.

16. An electric connecting arrangement for establishing electrical connection of an electronic printed-circuit board detachably mounted in a cabinet of an electronic installation at a front side thereof which arrangement comprises:

a connector support;

a frame support;

a sleeve means, with a flange, for adjustably connecting said connector support to said frame support and for permitting said connector and frame supports to be moved in both a horizontal and vertical direction relative to one another during a preliminary tightening phase;

a coaxial connector halve mounted in said connector support;

a spring element disposed between a portion of said coaxial connector halve and said connector support; and a multi-connector halve with resilient arms mounted in said connector support.

* * * * *